United States Patent [19]

Parrock

[11] Patent Number: 4,526,022

[45] Date of Patent: Jul. 2, 1985

[54] KEYLOCK WITH RESETTABLE, BENDABLE LEVER TUMBLERS

[75] Inventor: Joseph J. Parrock, Milford, Ohio

[73] Assignee: American Standard Inc., New York, N.Y.

[21] Appl. No.: 459,657

[22] Filed: Jan. 21, 1983

Related U.S. Application Data

[63] Continuation-in-part of Ser. No. 449,378, Dec. 13, 1982.

[51] Int. Cl.[3] ..... E05B 35/12; E05B 25/00

[52] U.S. Cl. ..... 70/339; 70/355; 70/384

[58] Field of Search ..... 70/382–385, 70/355, 377, 21, 285, 389, 339

[56] References Cited

U.S. PATENT DOCUMENTS

| | | | |
|---|---|---|---|
| 1,522,573 | 1/1925 | Benham | 70/385 |
| 1,561,207 | 11/1925 | Benham | 70/385 |
| 1,850,323 | 3/1932 | Heyer . | |
| 1,953,535 | 4/1934 | Hurd . | |
| 2,025,293 | 12/1935 | Nawn . | |
| 3,208,248 | 9/1965 | Tornoe . | |
| 3,255,620 | 6/1966 | Quillen . | |
| 3,315,503 | 4/1967 | Schlage . | |
| 3,447,348 | 6/1969 | Dauenbaugh | 70/285 |
| 3,727,439 | 4/1973 | Parrock . | |
| 3,978,700 | 9/1976 | Glass | 70/384 X |

*Primary Examiner*—Gary L. Smith
*Assistant Examiner*—Thomas J. Dubnicka
*Attorney, Agent, or Firm*—Wood, Herron & Evans

[57] ABSTRACT

Disclosed is a keylock having a key settable lever tumbler which can be bent, by use of an operating key, from an initial neutral configuration to set it to the operating key, and which by use of a change key can be restored to its initial configuration and then reset to other operating keys. The tumbler can be rebent and reset to different keys a substantial number of times. The accuracy of the rebending is assured by imparting an overbend which accommodates the spring back that accompanies the rebending.

11 Claims, 6 Drawing Figures

KEYLOCK WITH RESETTABLE, BENDABLE LEVER TUMBLERS

RELATED CASE

This application is a continuation-in-part of my copending application Ser. No. 449,378 filed Dec. 13, 1982, titled "Changeable Keylock Having Tumblers With Shiftable Pivot Seats."

FIELD OF THE INVENTION

This invention relates to a keylock wherein the key combination to which the lock has been set can be changed by first restoring bendable tumblers to an initial configuration with a change key, then inserting and turning another operating key while the tumblers are held against movement.

BACKGROUND

Locks of the general type to which this invention is directed have at least one tumbler in the form of a lever mounted for turning movement about a pivot when the tumbler is engaged by the lift of a cut key. To withdraw the bolt and open the lock, the tumbler must be turned by the key through a precise angle about its pivot, such that a gate or notch formed in the tumbler is aligned with a so-called "racking bar" on the bolt, or with a "comb" that moves with the bolt. If the gate of a tumbler is disaligned with the racking bar or comb, that tumbler blocks withdrawal of the bolt; if all the gates are aligned, they receive the racking bar or comb and permit the bolt to be withdrawn. In such locks the "shape" of the key, or more precisely, the heights of the respective lifts of the key, control the positions to which the tumblers are turned by rotation of the key; or conversely, the positions at which the tumbler gates are aligned control the shape of the key. In order to set the lock for opening by a particular key, or to reset it to a different key, it is necessary to change the degree of rotary movement which brings one or more of the tumblers into position of gate alignment.

THE PRIOR ART

It is known to provide a lock with a lever tumbler having a bendable or deformable portion by which the tumbler can be shaped in the lock, to be aligned by a particular key. Such a lock is described in U.S. Pat. No. 3,727,439, issued April 17, 1973, titled "Modular Keylock Having Lever Tumblers With Bendable Portions," of which I am the inventor. In the lock taught in that patent the bendable tumblers are fitted to a particular cut key by inserting the key into the lock and turning it while the tumblers are held against turning. The turning movement displaces bendable portions of the tumblers to new positions corresponding to the respective lift heights of the operating key which is used to carry out the bending. Those locks are particularly useful as safe deposit locks which they can be made in a modular form and which can easily be set to a particular key at the time of installation.

More specifically, my prior patent teaches a lock including a lever tumbler having a bendable key-engaging portion. Prior to bending, the tumbler rests against a first stop in the lock in a position such that the tumbler gate is in alignment to receive the bolt. The bendable portion is initially bendable by an operating key. By turning the key in engagement with the tumbler while the tumbler is held against rotation, the bendable portion is moved from its initial configuration or position to a new or set configuration, according to the shape of the particular key lift which bends it. A second stop becomes active after the bendable portion has been bent by the key. The bending moves a first stop-engaging surface of the tumbler and renders it inactive; a second stop-engaging surface of the tumbler then becomes active and the tumbler is then arrested by the second stop in a position of disalignment the bolt.

The lock described in my U.S. Pat. No. 3,727,439 can be set once to cooperate with a particular key, but it cannot thereafter be reset to a different key having lower lifts. Once the tumbler of that lock has been bent to be aligned by a given key lift, it cannot readily be rebent to a different lift, higher or lower. However, for some applications it is desirable to change the combination of a lock from one key to another key. By way of example, such a feature is useful for setting the guard keys of safe deposit locks. Guard keys are not often changed but they may occasionally be changed, as when bank ownership changes or when a group of safe deposit boxes is moved to a different location. It has therefore been desirable to provide a lock of the bendable tumbler type which can respond not only to an initial setting, but which can thereafter be reset to other keys having lifts which may be either lower or higher than those of the key to which the lock was initially set.

BRIEF DESCRIPTION OF THE INVENTION

Unlike the lock of my prior patent, the lock of this invention can be set not only to an initial operating key, but can thereafter be reset to coact with other operating keys having tumbler lifts which are either higher or lower than the lifts of the first key to which the lock was set. This invention provides means for rebending the tumblers to set them to different keys.

Such changing from a set position is accomplished by first restoring the tumbler to its initial (as manufactured or neutral) position or configuration, then resetting it from the initial configuration to a new configuration with a different operating key. The tumbler, once set, is returned or rebent to its initial configuration by the provision of a change key which acts oppositely on the tumbler from the bending effected by the operating key. The operating key engages an operating key-engaging edge of the tumbler and can bend a bendable portion of the tumbler in one direction from its initial configuration to set the tumbler; the change key operates on an opposite edge of the tumbler and bends the tumbler back toward the initial configuration. It is important that the change key bends the tumbler beyond the initial configuration as will be explained.

A first stop in the lock is positioned to arrest the tumbler in a rest position in which, when the tumbler is in its initial configuration, it is in alignment with the bolt, so that the bolt can be withdrawn to hold the tumbler while it is being set. When the tumbler has been set this first stop is inactive and a second stop becomes active. The first stop again becomes active when the tumbler is rebent to initial configuration. However, in order that the tumbler gate will again align with the bolt for resetting, the tumbler is overbent past the initial configuration in which it originally engaged the first stop, sufficiently that when the change key is disengaged the bendable position "springs back" so that the tumbler is again in its initial configuration and its gate will again align with the bolt when in rest position. The first stop is movable to permit such overbending. In preferred embodiment, the operating key post provides the first stop. This stop is "removable" by rotating the operating keypost to position a relief on the post adjacent the tumbler. The relief provides space into which the tumbler can be overbent, and from which the tumbler will spring back to initial configuration.

The invention can best be further described and its operation explained by reference to the accompany drawings, in which.

DETAILED DESCRIPTION

Although the improvement of this invention can be used in many types of key changeable locks, its widest utility is expected to be in locks for safe deposit boxes. For that reason the preferred embodiment of the invention is primarily described hereinafter in relation to a lock for that use.

Safe deposit boxes commonly use two keys for operation. One key, called the guard key, is retained by the bank or other institution in which the safe deposit box is located. That key must be used in conjunction with a separate customer key which is retained by the customer. The bank cannot open the box by using the guard key without the use of the customer's key; and the customer cannot open other boxes. The guard and customer keys act on guard and customer tumblers respectively in each lock. Either the guard tumblers or the customer tumblers, or both, may be key changeable. The mechanism for changing the guard key may be different than that for setting or changing the customer key, or the customer key may not be changeable.

The drawings illustrate a safe deposit box lock having a set of guard tumblers and a set of customer tumblers, wherein the guard tumblers are changeable in accordance with this invention, but wherein for simplicity the customer tumblers are not changeable and are the same as those shown in my previously identified U.S. Pat. No. 3,727,439, to which reference may be had for a more complete description of their structure and operation. Alternatively, the customer tumblers may be changeable in accordance with this invention, or they may be changeable by another mechanism, as for example is taught in my co-pending patent application Ser. No. 449,378, filed Dec. 13, 1982, titled "Key Changeable Keylock Having Tumblers With Shiftable Pivot Seats," to which reference may be had.

Figure 1:
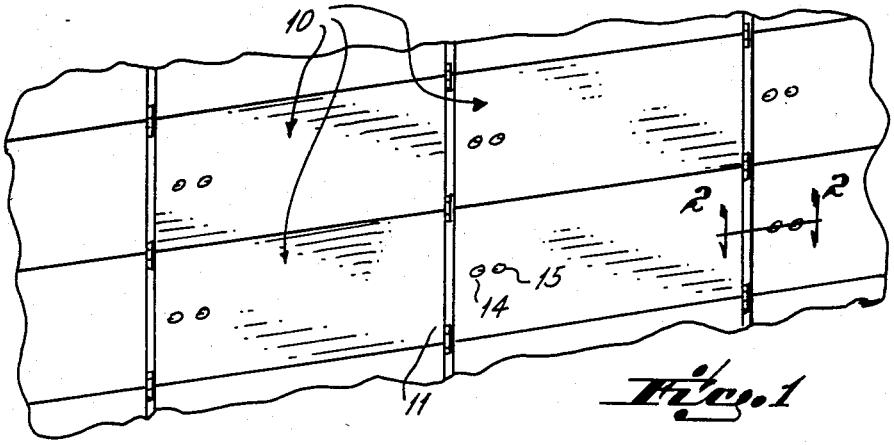
FIG. 1 is a fragmentary perspective view of a typical environment in which the lock of this invention may be used, comprising a series of safe deposit boxes.

Referring to the drawings in detail, FIG. 1 illustrates a safe deposit box installation which includes a plurality of lockable doors each designated by 10. Each door is hinged at one side as at 11. The lock side of each door (the left side, as viewed in FIG. 1) has two key-receiving noses 14 and 15. These receive customer and guard keys respectively for operating the lock, which is mounted on the inside of the door and which is designated by 18 (see FIG. 2). The guard key (sometimes referred to herein as the "operating key" by way of generalization) will typically operate the guard tumblers of all of the locks in the installation; but each lock typically requires its own individualized customer key to operate its customer tumblers. Both the customer and guard tumblers must be aligned before the bolt can be withdrawn.

As shown in FIGS. 2 and 4–6 the lock 18 is fastened by machine screws 19 to the inside surface of the box door 10, and is contained within a two-part housing which includes a case 20 and a lid or cover plate 21. Lid 21 is disposed against the inside of door 10, with the two noses 14 and 15 projecting from the cover into apertures formed in door 10, substantially to the surface of the locked door. Noses 14 and 15 receive customer and guard keys 34 and 35 respectively, see FIGS. 5 and 6.

Figure 4:
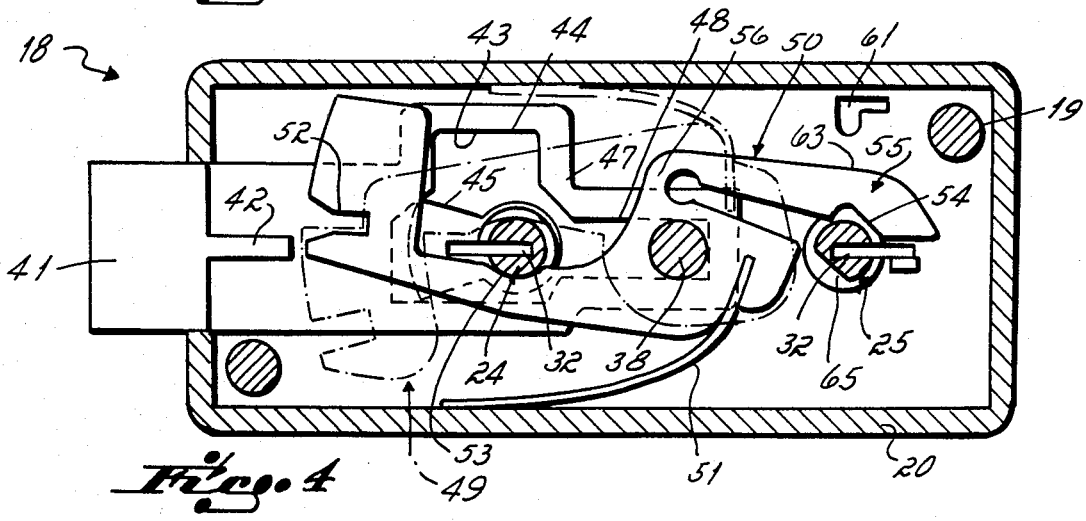
FIG. 4 is a vertical section taken on line 4—4 of FIG. 2 showing the lock after it has been set to a key, and is in locked condition with the tumblers in a scrambled or unaligned condition.
Figure 5:
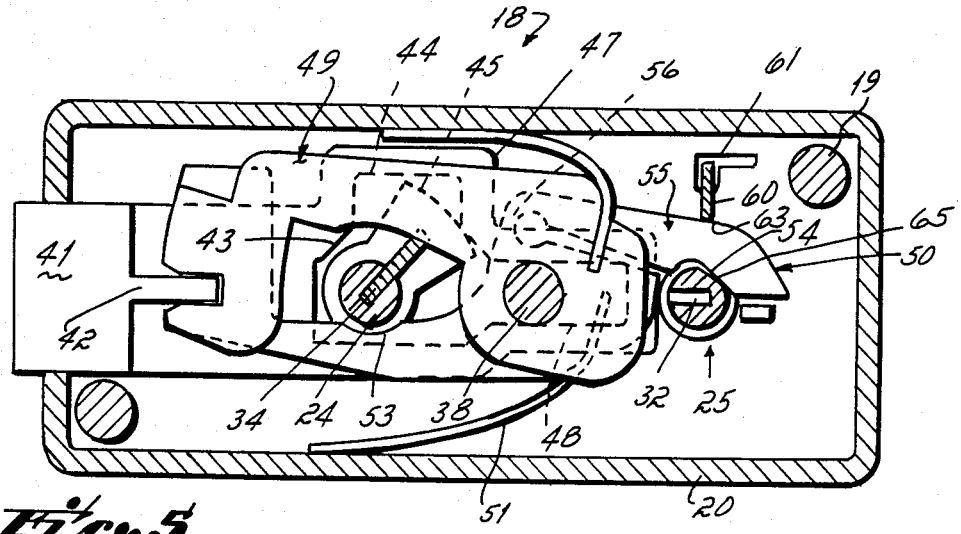
FIG. 5 is a vertical section similar to FIG. 4, but shows the lock in unlocked condition with the change key engaging on the tumbler to rebend it to initial configuration.
Figure 6:
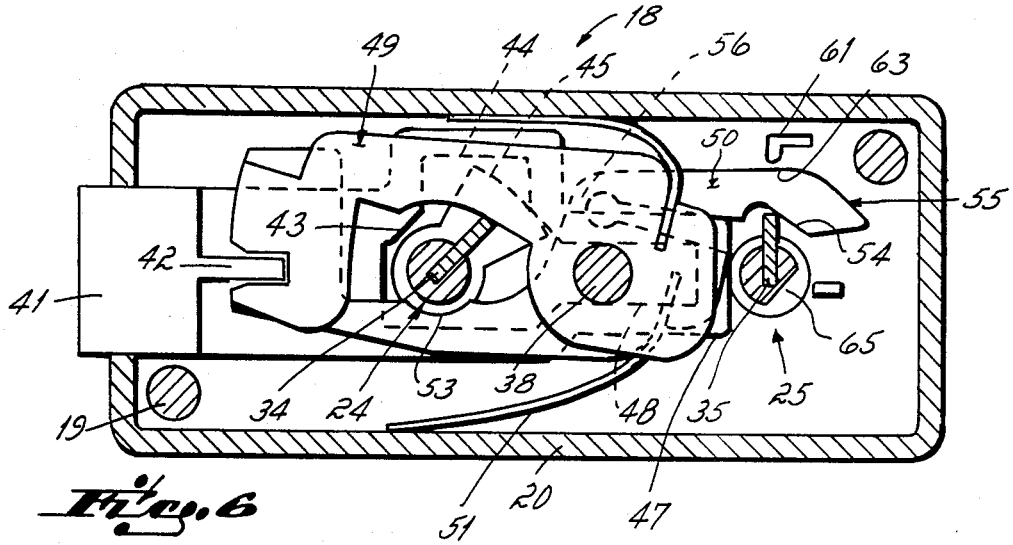
FIG. 6 is a vertical section similar to FIGS. 4 and 5, but shows the lock in unlocked condition with the tumblers being bent by another key, from initial configuration to a new configuration.

A key post 24 (which receives the customer key) and a key post 25 (which receives the guard key) are rotatably supported at their opposite ends between the noses 14, 15, respectively, and apertures 26, 26 in the back of the lock case 20. Each key post 24, 25 has an elongated shank portion 28 and an enlarged head 30, which is retained by a flange or rim in the respective nose 14, 15. Thus, each key post 24 and 25 is rotatable within its respective journals, but cannot shift axially. As shown in FIGS. 4–6, the key posts 24 and 25 are slotted along their length as at 32, to receive customer key 34 and guard key 35, respectively.

Figure 2:
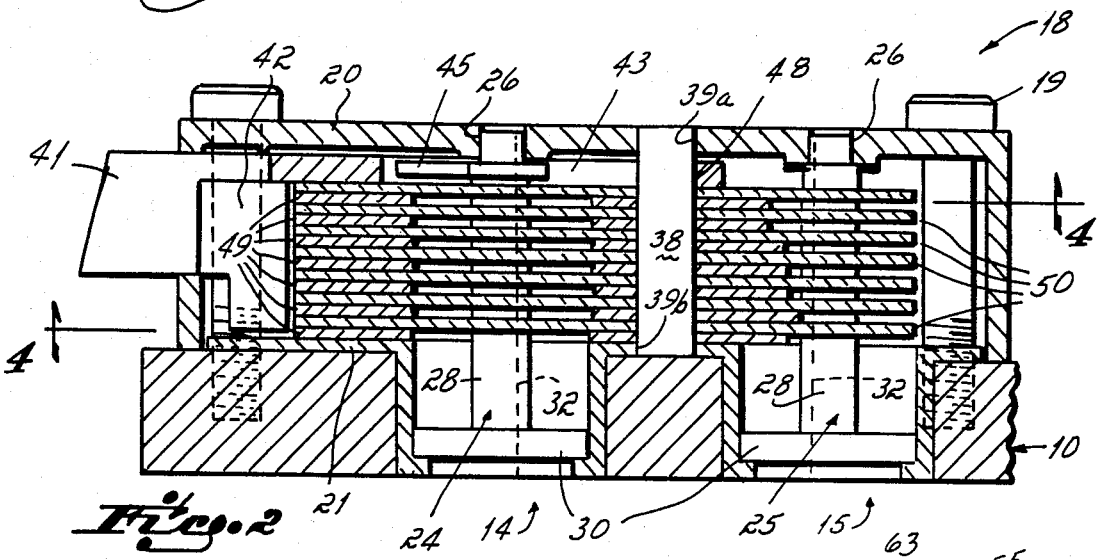
FIG. 2 is a horizontal section taken on line 2—2 of FIG. 1, showing a preferred embodiment of a lock in accordance with the invention.

A tumbler pivot in the form of a post 38 is mounted between lid 21 and the inner or back surface of lock case 20 (see FIG. 2). Post 38 may be a roll pin which is secured in apertures **39*a* and 39*b* in the case and cover respectively, to hold the case and cover in closed relation before the lock is secured to door 10 by screws 19. In the embodiment illustrated, this post 38** serves as the pivot for both of the two sets of tumblers.

Lock case 20 has an endwise opening through which a bolt 41 extends. The bolt includes a so-called bolt pin or racking bar 42, and is movable between an extended (or locked) position shown in FIGS. 2 and 4, and a retracted (or open) position shown in FIGS. 5 and 6. The bolt has an extension plate 47 within lock case 20 which resides adjacent the case inner wall and which presents an aperture or opening 43. Tumbler pivot post 38 extends through an elongated longitudinal extension 48 of aperture 43 and supports and guides the bolt for sliding movement between the retracted and extended positions. Aperture 43 also includes a portion 44 which is engaged by and cooperates with a bolt thrower in the form of key bit or foot 45 mounted at the inner end of the rotatable customer key post 24. The shape of the bolt aperture in contact with key bit 45 limits the extension and retraction of the bolt.

Figure 3:
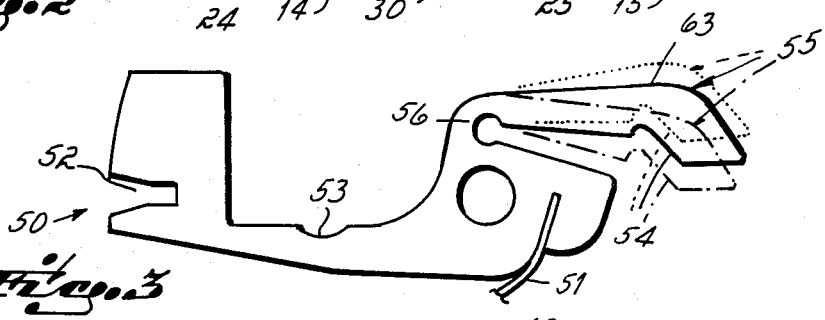
FIG. 3 is an elevation of an individual guard tumbler in accordance with the preferred embodiment of the invention, and illustrating some of the different configurations to which the tumbler can be bent.

Lock 10 includes a set of customer tumblers, each designated by 49 in FIG. 2, which are operated by customer key 34, and a set of guard tumblers 50 (one of which is shown in FIG. 3) which are operated by guard (or operating) key 35. In the illustrated embodiment there are seven tumblers of each type which are arranged alternately with one another within the case (see FIG. 2), however neither the number of tumblers nor their arrangement with one another is critical. All of the tumblers 49, 50 pivot about post 38.

As shown in FIG. 2, the customer and guard tumblers are preferably interleaved with one another on post 38; a customer tumbler 49 is adjacent lid 21, next to guard tumbler 50, then a second customer tumbler, etc. For further description of a suitable type of customer tumbler 50, reference may be had to my previously identified U.S. Pat No. 3,727,439, or to my copending application Ser. No. 449,389.

Only a single customer tumbler 49 and a single guard tumbler 50 are shown in FIGS. 4–6 in order to simplify those drawings. However, it will be apparent that the other tumblers of the respective sets can be similar in outline form, except that they may vary from tumbler to tumbler in respect to gate position, and hence position of alignment.

The guard tumbler 50 is preferably in the form of a thin, flat member, one of which is shown in FIG. 3. It can be seen that the shape of tumbler 50 itself can be the same as that shown in my previous patent. The tumbler is pivoted for rotation on post 38 and is biased clockwise about that pivot by a spring 51. At one end each tumbler 50 has a gate 52 which receives the racking bar 42 of the bolt when the bolt is withdrawn (see FIGS. 5 and 6). When a combination has been set into the lock by bending the tumbler in a manner to be described, the tumbler is arrested in a rest position by a stop edge or surface 53 on the tumbler which bears against the customer key post shank 28. In such rest position the tumbler gate is disaligned from the bolt pin.

Guard tumbler 50 has a guard (or operating) key-engaging edge 54, which is preferably positioned on an elongated arm 55 of the tumbler, as shown in FIG. 3. Arm 55 is bendable, with respect to the gate, about a bending zone 56. In the embodiment shown the bending zone 56 comprises a narrow neck. Some of the configurations to which arm 55 can be bent with respect to gate 52 are illustrated in FIG. 3, which in phantom lines shows an initial, as manufactured, or neutral configuration; in solid lines, a set configuration corresponding to one key lift, and in dotted lines another set configuration corresponding to a different key lift.

As originally manufactured or supplied, the tumbler is unbent and is in its neutral or initial configuration. In this configuration edge 54 acts as a first stop surface and, under the bias of spring 51, rests on post 25; under these circumstances stop edge 53 is inactive, that is, it is spaced from post 24. In such rest position the tumbler gate is aligned with the racking pin 42 so that the bolt can be withdrawn by throwing the bolt bit, without further gate alignment.

The tumbler can be bent from the initial configuration to a set configuration (i.e., a first key lift height configuration) by turning guard key 35 while the tumbler is held against bending. The tumbler can be held against bending by various means such as pinning or clamping, but preferably bolt pin 42 is engaged in tumbler gate 52 for that purpose. With the tumbler held against bending, it is set to a given key lift height by operating the guard key to engage surface 54 and thereby bend arm 55 about neck portion 56 (counterclockwise, as seen in FIG. 3). The manner in which tumbler 50 is set is similar to that disclosed in my earlier patent; however, in that patent there is no suggestion as to how the tumbler could be set to another key lift, especially one of lower lift height. Originally it was not thought that a tumbler, once bent, could later be changed. Moreover, the earlier patent disclosed no means for changing the tumbler to a different key. Still further, even if the tumbler could have been rebent toward an initial or neutral configuration, in which edge 54 again functions as a stop as it rests against post 25, the arm would not have retained that position but because of spring back would have moved to a somewhat different position as soon as the bending force was removed.

It has now been found, contrary to expectation, that the tumbler can be rebent to the initial or neutral configuration, and a means for taking account of spring back has been found. The tumbler is bent back to initial configuration by bending it in the direction (clockwise, in FIGS. 4–6) opposite to which it was first bent. A guard tumbler change key 60 is provided to accomplish this reverse bending (FIG. 5). However, mere rebending to bring edge 54 back into contact with post 25 is not sufficient, because the arm 55 will spring away from the post when the guard key is disengaged from it. It has been found that the effect of such spring back can be compensated by overbending the arm, past its initial position. Post 25, which acts as the stop, would ordinarily block this; however, this "stop" is rotatable and a relief 65 to be described is provided on the post which locally reduces its diameter to permit a sufficient amount of overbend, such that spring back moves surface 54 to its initial neutral position.

The change key 60 is inserted in lock case 20 through an aperture 61 in the bottom of the case. The tip of the key is supported and journaled in a recess (not shown) in lid 21.

As shown in FIG. 5, change key 60 engages an edge 63 of arm 55 which is on an opposite side of the arm from edge 54. In order to return arm 55 to initial position, it is first bent beyond that position by the change key. To allow this "overbend," a relief or flat 65 is provided on key post 25, on the side thereof which is adjacent edge 54 when the change key is being operated (see FIG. 5). When keypost 25 is oriented rotationally so that relief 65 is turned away from arm 55, as shown in FIG. 4, the post circumference adjacent edge 54 will engage and arrest the edge of the tumblers in the initial configuration and would thus prevent overbending; when post 25 is turned so that flat 65 is toward edge 54 (FIG. 5) the post circumference does not arrest edge 54. In other words, the stop provided by post 25 is movable (rotatable) into a position in which the post does not arrest the overbending; the movement brings the relief into a position which in effect removes the stop. Relief 65 thus allows arm 55 to be bent past that position at which surface 54 would otherwise be arrested by post 25.

Prior to bending the tumbler from initial configuration to fit a key, edge 54 acts as a first stop engaging edge, in that it is arrested by post 25 which thereby controls tumbler gate position. When the tumbler has been bent to fit a particular key, arm 55 is displaced from its original position, as already described, sufficiently far that edge 53 becomes active as a second stop edge. In the rest position edge 53 then bears against customer key post 24 which acts as a second stop that controls the rest position of the tumbler. Under those circumstances, the tumbler is disaligned.

Surprisingly, and contrary to earlier expectations, I have found that a tumbler can be bent and rebent accurately to cooperate with different keys, at least as many as 25 times. This is more than sufficient to permit all the guard key changes that would ever be needed. To facilitate such repeated rebending, the material of which the tumbler is made should not be resilient but should be deformed by the bending. A suitable material is copper alloy number 342, however from what has been said it will be recognized that other appropriate materials can be used.

In the past the guard tumblers on safe deposit boxes have had to be either assembled to match the particular guard key of the installation in which they are to be used or, once set to a particular guard key, could not be changed from that guard key. The present invention overcomes that problem. The lock can be fitted to an initial guard key and then, if the guard key should be changed, can be rebent to fit a different guard key.

By way of summary of the operation of the preferred form of lock, to change the guard tumblers of the lock above described from one key to another, the following steps are followed:

(a) The first guard key 35 is inserted and rotated to set up (align) the guard tumblers.

(b) The customer key 34 is inserted and rotated. This puts the lock in the condition shown in FIG. 6, with the bolt withdrawn.

(c) Guard key 35 is then turned back to the insert position and removed. Guard tumbler post 25 is then rotated, as by the tip of the key, until relief 65 is aligned with tumbler edge 54.

(d) The change key 60 is inserted and rotated to the position shown in FIG. 5 and then rotated back and removed. This returns the guard tumblers to initial or neutral configuration.

(e) The tumbler post 25 is then rotated back to the key entry position. The new guard key is inserted and turned to bend the tumbler from neutral configuration to the new configuration.

The lock has thereby been set to the desired new key and is ready for normal operation.

Although the invention has been described primarily in relation to use in the guard keys of dual key safe deposit locks, from what has been said it will be appreciated that tumblers in accordance with the invention are generally useful in either or both sets of tumblers in dual key safe deposit locks, or they can be used in single key locks. The invention can also be used to reset a portion, less than all, of the tumblers in a lock.

Having described the invention, what is claimed is:

1. In a lock having at least one key settable lever tumbler of the type wherein the position of an operating key-engaging edge of the tumbler can be set relative to a gate in the tumbler by turning an operating key to bend a bendable portion of the tumbler in a first direction from an initial configuration to a set configuration;

the improvement comprising, a change key and means presented in said lock for receiving and journaling said change key in such position that the change key can be turned to engage a change key-engaging edge of the tumbler, the change key being configured to rebend the bendable portion of the tumbler in the direction opposite to the first direction, and to overbend said bendable portion sufficiently beyond said initial configuration that when the change key is disengaged from the tumbler said bendable portion springs back in the first direction until the operating key-engaging edge substantially returns to said initial configuration.

2. In a lock having at least one key settable lever tumbler of the type wherein the position of an operating key-engaging edge of the tumbler can be set relative to a gate in the tumbler by turning an operating key to bend a bendable portion of the tumbler in a first direction from an initial configuration to a set configuration, the improvement comprising, a change key and means presented in said lock for receiving and journaling said change key in such position that the change key can be turned to engage a change key-engaging edge of the tumbler, the change key being configured to rebend the bendable portion of the tumbler in the direction opposite to the first direction, and to overbend said bendable portion sufficiently beyond said inital configuration that when the change key is disengaged from the tumbler said bendable portion springs back in the first direction until the operating key-engaging edge substantially returns to said initial configuration, said improvement further including movable stop means in the lock for arresting the tumbler in a position of gate alignment with a bolt when said operating key-engaging edge is in said initial configuration, said stop means being movable to a position in which it does not arrest said tumbler during said overbending.

3. The improvement of claim 1 wherein said lock journals said change key for engagement with a change key-engaging edge on the tumbler which is on an opposite part of the tumbler from said operating key-engaging edge.

4. The improvement of claim 3 wherein said operating key-engaging edge and said change key-engaging edge are presented on opposite sides of an elongated arm of the tumbler which is bendable with respect to the gate.

5. The improvement of claim 2 wherein said stop means is rotatable with respect to said operating key-engaging edge and presents a relief which can be positioned by rotation of the stop means so as not to arrest said tumbler during said overbending.

6. The improvement of claim 2 wherein said stop means is a rotatable keypost for receiving said operating key.

7. The improvement of claim 6 wherein said keypost presents said relief in one side thereof which relief may be positioned by rotation of said keypost to permit said overbending without the tumbler engaging said keypost.

8. The improvement of claim 7 wherein the relief on said keypost is turned away from the operating key-engaging edge when the bolt is extended and is turned toward the operating key-engaging edge by rotation of the keypost when said tumbler is to be rebent.

9. In a lock having at least one key settable lever tumbler of the type wherein the position of an operating key-engaging edge of the tumbler can be set relative to a gate in the tumbler by turning an operating key to bend a bendable portion of the tumbler in a first direction from an initial configuration to a set configuration, and wherein the tumbler when in said initial configuration rests on a stop in the lock with its gate in alignment to receive a bolt, the improvement comprising, a change key, means presented by said lock for receiving and journaling said change key in such position that the change key when rotated engages a change key-engaging edge of the tumbler, the change key being configured to rebend the bendable portion of the tumbler in the direction opposite to the first direction, and to overbend said bendable portion sufficiently beyond said initial configuration that when the change key is disengaged from the tumbler the bendable portion springs back in the first direction until the operating key-engaging edge returns to said initial configuration, and means for moving said stop to such position that it does not arrest said tumbler during said rebending.

10. The improvement of claim 9 wherein said stop is a rotatable keypost which receives the operating key and presents a relief which is movable by rotation of the keypost so that the keypost does not arrest the tumbler during said overbending.

11. In a keylock having at least one key settable lever tumbler of the type wherein the position of an operating key-engaging edge of the tumbler can be set relative to a gate in the tumbler by turning an operating key to bend a bendable portion of the tumbler in a first direction from an initial configuration to a set configuration, the improvement comprising, a change key, means presented by the lock for receiving and journaling said change key in such position that the change key when rotated engages a change key-engaging edge of the tumbler, the change key being configured to overbend the bendable portion of the tumbler in the direction opposite to the first direction, sufficiently beyond said initial configuration that when the change key is disengaged from the tumbler the bendable portion springs back in the first direction to said initial configuration, and a rotatable keypost in the lock for receiving said operating key and for positioning the operating key to engage said operating key-engaging surface on the tumbler, said keypost acting as a stop to position the tumbler in a position of gate alignment with the bolt when the tumbler is in said initial configuration, said keypost having a relief at one portion thereof which can be positioned adjacent said tumbler so that said keypost does not stop the tumbler and permits said overbending.

* * * * *